US006890173B2

(12) United States Patent
Puig-Gros

(10) Patent No.: US 6,890,173 B2
(45) Date of Patent: May 10, 2005

(54) POCKET LIGHTER

(75) Inventor: Juan Lucas Puig-Gros, Barcelona (ES)

(73) Assignee: Flamagas, S.A. (ES)

( * ) Notice: Subject to any disclaimer, the term of this patent is extended or adjusted under 35 U.S.C. 154(b) by 0 days.

(21) Appl. No.: 10/472,748

(22) PCT Filed: Mar. 25, 2002

(86) PCT No.: PCT/ES02/00152

§ 371 (c)(1),
(2), (4) Date: Sep. 24, 2003

(87) PCT Pub. No.: WO02/077532

PCT Pub. Date: Oct. 3, 2002

(65) Prior Publication Data

US 2004/0096792 A1 May 20, 2004

(30) Foreign Application Priority Data

Mar. 26, 2001 (ES) ..... 200100698

(51) Int. Cl.[7] ..... F23D 11/36
(52) U.S. Cl. ..... 431/153; 431/277
(58) Field of Search ..... 431/153, 277, 431/344, 129, 267; 131/329

(56) References Cited

U.S. PATENT DOCUMENTS

| | | | | |
|---|---|---|---|---|
| 5,547,370 A | | 8/1996 | Hwang | |
| 5,735,294 A | | 4/1998 | McDonough et al. | 131/329 |
| 5,769,098 A | * | 6/1998 | McDonough et al. | 131/329 |
| 6,053,727 A | | 4/2000 | Potskhishvili et al. | |
| 6,142,768 A | | 11/2000 | Feng et al. | |
| 6,485,291 B2 | * | 11/2002 | Adams | 431/153 |
| 2003/0031968 A1 | * | 2/2003 | Sewalt | 431/153 |

FOREIGN PATENT DOCUMENTS

| | | |
|---|---|---|
| EP | 0 829 686 A1 | 3/1998 |
| FR | 2 752 045 | 2/1998 |
| GB | 675121 | 7/1952 |
| WO | WO 96/41103 | 12/1996 |
| WO | WO 97/01734 | 1/1997 |
| WO | WO 01/13043 | 2/2001 |

* cited by examiner

*Primary Examiner*—James C. Yeung
(74) *Attorney, Agent, or Firm*—Ostrolenk, Faber, Gerb & Soffen, LLP

(57) ABSTRACT

The invention relates to a pocket lighter of the type that comprises a fuel container (1), a valve (2), which regulates the opening and closing of said container, a pyrophoric flint (6), a revolving toothed wheel (8), which can produce sparks that are directed towards the valve (2), spring means (7), which exert a force that applies the flint against the toothed wheel, and two disks (10) having end journals (12) that move in respective housings (13). The inventive lighter is characterised in that, in addition to acting as the force transmission element between the finger and the wheel (8), the disks (10) also serve as a rotor for a braking device in which the stator is formed by an element (15) that rubs against said rotor. More specifically, the stator of the braking device comprises a spring (15) which acts on a smooth surface of the rotor (10) in a radial or tangential direction. The spring (15) may form part of the actual structure of the button (14) or it may be independent of said button.

11 Claims, 3 Drawing Sheets

FIG. 1bis

POCKET LIGHTER

Of the type that incorporate a fuel reservoir (1), a valve (2) that regulates the opening and closing of the reservoir, a pyrophoric stone (6), a rotatable toothed wheel (8) for producing sparks directed towards the valve (2), spring means (7) that exert a force that tends to apply the stone against the toothed wheel and two discs (10) with end journals (12) which operate in their respective housing (13). It centres its characteristics on the fact that the discs (10), in addition to performing the function of force transmission element: between finger and wheel (8), performs the function of rotor for the braking device wherein the stator is formed by an element (15) which rubs against said rotor. More specifically, the braking device's stator is materialized in a spring (15) which acts on the rotor (10) in a radial or tangential direction on a smooth surface of the latter. The spring (15) can form part of the button's structure (14) or be an independent element thereof.

DESCRIPTION

Object of the Invention

The present invention refers to a pocket lighter, of the type that includes a fuel reservoir, an outlet valve thereof, a pyrophoric stone, a spark wheel which on meeting with the stone generates sparks orientated or directed towards said valve and a spring which tends to project the pyrophoric stone against the spark wheel.

The object of the invention is to achieve a lighter equipped with a simple mechanism which guarantees its safety, making the lighting manoeuvre difficult when the lighter is handled by children under five.

BACKGROUND OF THE INVENTION

The documents WO 97/01734 and EP 0 829 686 A1 have safety mechanisms whose functioning is based on specifications of the actuator's surface geometry in its contact area with the finger on performing the lighting manoeuvre. The different solutions claimed in these documents have the objective of reducing the friction coefficient between finger and actuator. In this manner, to achieve the actuator's rotation, it is necessary to increase the force applied with the finger in a radial direction in the lighting manoeuvre.

Even though the embodiments mentioned present simple, economic execution solutions, they base the safety in the increase in the operation force, fundamentally in radial direction, with the object of managing to increase the tangential pull force component of the finger that causes the actuator's rotation. Logically, the minimum operating force necessary to cause the actuator to rotate will only depend on the spark wheel's reaction force on the stone, with this being limited by the spring's compression force. The value of the force is further limited, both by the space restrictions of the spring's chamber in the lighter and by the stone's life. In this situation, said minimum reaction force of the pull train on the stone will depend on its wear, given that the spring's compression stroke is limited by the stone; thus, this minimum force will be reduced with the lighter's use, for which reason, the reliability of the safety mechanism will not be guaranteed.

The document U.S. Pat. No. 5,520,197 discloses a lighter with several safety mechanisms, fundamentally based on having an element that forms part of the trim, and which obstructs contact between finger and actuator. They base the safety on the minimum effort necessary to deform this structural element with the finger and accede therewith to the actuator, furthermore, combining spark wheel blocking systems with operating levers.

The document U.S. Pat. No. 5,096,414 discloses a lighter with a safety system wherein the actuators rotate freely on an axis coaxial with the spark wheel. They base the safety in the accessibility of the finger to the spark wheel due to the finger's deformation on increasing the operating force in a radial direction on the actuators.

The document U.S. Pat. No. 4,717,335 discloses a lighter wherein the safety is based on the spark wheel's limited path due to a mechanical stop placed thereon. This solution, in addition to the ergonomic problems it provides, does not make it too difficult for children to obtain a flame, taking into account that they may have a lot of time available, that tests are especially attractive for them, and that the lighting manoeuvre being visually noticeable, will be rapidly assimilated from learning by imitation.

DECRIPTION OF THE INVENTION

The invention proposes to overcome the abovementioned drawbacks by having mechanisms to prevent or make their use difficult for children.

The invention is applicable to a pocket lighter which comprises: a fuel reservoir, hereinafter "reservoir"; a valve, hereinafter "valve", to regulate the opening and closing of said reservoir and which is equipped with an outlet, which, when the lighter is in vertical position, determines the outlet level; a pyrophoric stone, hereinafter "stone"; a wheel with teeth, hereinafter "spark wheel", rotatable and adapted to produce sparks against said valve, on rotating in one direction and rubbing against said stone; the spring means which exert a force that tends to apply said stone against said spark wheel, hereinafter "spring", a rotation shaft, hereinafter "actuators", coaxial with said spark wheel, and equipped with end journals; and housing for each of said end journals. The lighter also has a decorative element, hereinafter "trim", which has both structural functions and acts as a combustion chamber. The array formed by the spark wheel and the actuator is hereinafter "pull train".

The invention provides a lighter, as disclosed, which includes an additional mechanism acting as a safety element. The system is reliable, inviolable, constantly in operation and without user intervention.

The invention contemplates a mechanism, capable of creating a reaction force or reaction pair due to rotation resistance from friction in one or both directions in the actuator(s), applied in radial and/or axial direction thereof, and which is superimposed on the reaction force on the spark wheel created by the stone.

The invention contemplates that said force/reaction pair on the actuator(s) can be obtained from the design and with a continual and/or alternate temporary characteristic value, and of progressive or regressive constant value, in accordance with the actuators' rotation angle.

An advantage of the invention is that this force can be regulated in accordance with the characteristics of the pull trains, and therefore adaptable to lighters on the market; furthermore, it is in constant operation; its industrialisation does not require important modifications in lighters that lack safety systems and large investments are not needed.

In the invention's first preferred embodiment, said mechanism is constituted by a new element that forms part of the lighter, constructed in metal or plastic material and which acts as a spring on the actuator(s) acting in radial and/or axial direction.

In the invention's second preferred embodiment, said mechanism is constituted by a protuberance over the button, of deformable structural characteristics under the force produced by the assembly interference, and which comes into radial and/or axial contact with the actuator(s). This protuberance can be placed likewise on the lighter's structure.

DESCRIPTION OF THE DRAWINGS

To complement the description being provided and with the object of helping towards a better understanding of the characteristics of the invention, in accordance with a preferred example of practical embodiment thereof, a set of drawings is attached, being an integral part of said description, wherein the following is represented with an illustrative, non-limiting character.

PREFERRED EMBODIMENT OF THE INVENTION

Figures 1, 2, 3:
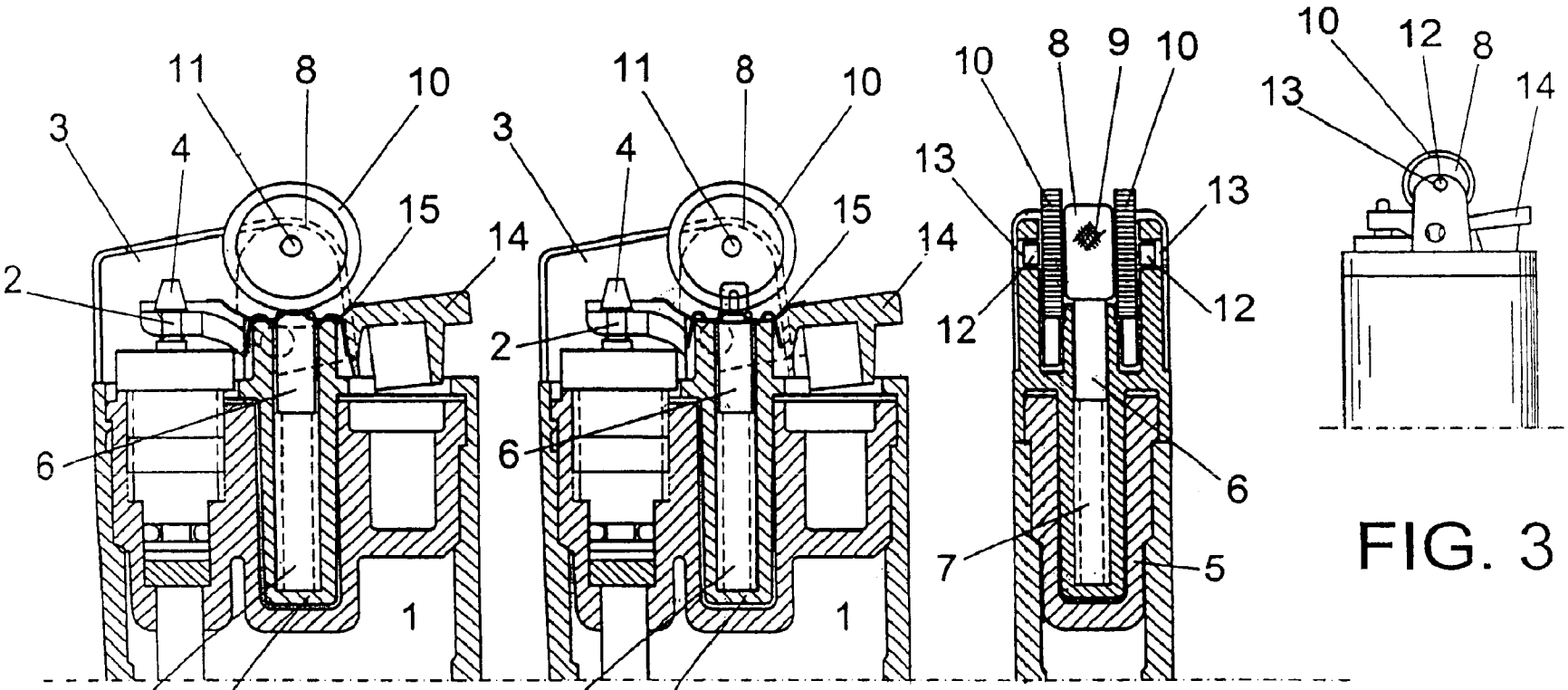
FIG. 1 and FIG. 1 bis show two schematic views, in two partial sections, of a lighter made in accordance with the object of the present invention, by a plane of symmetry thereof.
FIG. 2 shows a schematic view, in partial section, by a plane perpendicular to the previous one.
FIG. 3 shows a smaller scale representation of the lighter's lateral elevational view.
Figure 4:
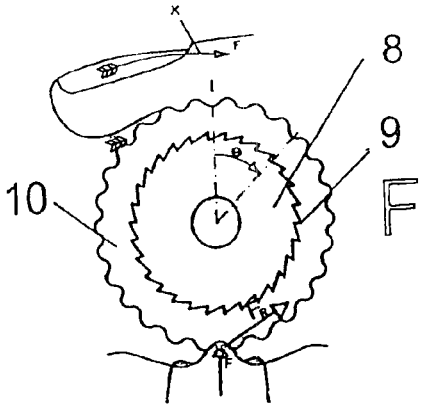
FIG. 4 shows a schematic representation of a pull train in which at least one of the actuators has a rough geometry contact surface between finger and spring, a spark wheel whose teeth scratch the pyrophoric stone, the actuator(s) that transmit the rotation movement to the former and the finger that operates them in the direction of operational rotation that generates pyrophoric energy. A specific geometry of the spring which causes a radial resistance force when the actuator(s) rotate when operated by the finger, is also shown.
Figure 5:
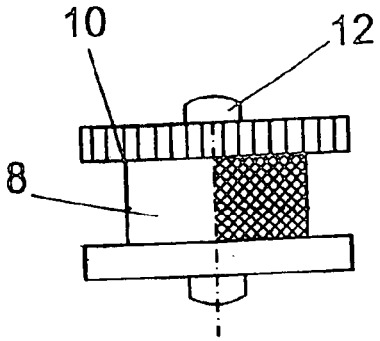
FIG. 5 shows a plan view of the pull train array wherein one actuator shows a flat surface, and the other actuator shows a rough surface with a uniform or quasi-uniform geometry throughout its circular expansion.
Figure 6:
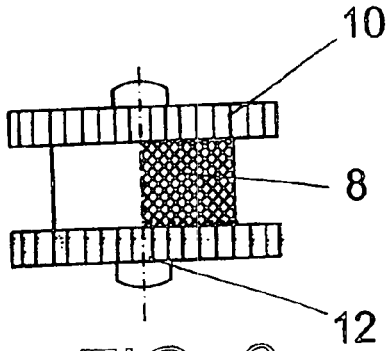
FIG. 6 also shows a plan view of the pull train array wherein the actuators show rough surfaces with two uniform or quasi-uniform profile geometries throughout its circular expansion.

The lighter, which is the object of the invention, comprises a fuel reservoir (1) and a valve (2) that regulates the opening and closing of the reservoir. This valve (2) is equipped with an outlet (3) which, when the lighter is in vertical position, determines the outlet level (4), which will be again referred to subsequently.

A pyrophoric stone (6) is housed in a small container (5) which a spring (7) [represented in a more schematic form] maintains pressed against a wheel (8) with teeth (9) [FIGS. 5, 6, 8 and 9] that, in practically all the embodiments, is flanked by two operating discs (10). The wheel (8) has a rotation shaft (11) equipped with two end journals (12) each in its housing.

In the manner of the embodiment presented, the valve (2) is operated, as is habitual, by means of a button (14), over which the user's finger is applied after having made the wheel (8) rotate in the first direction. In this first direction, on rubbing against the pyrophoric stone (6), the wheel is adapted to produce sparks directed towards the valve (2). In this first direction, in FIGS. 1, 1 bis and 3, it is a clockwise direction, whilst in FIGS. 4, 8, 11 and 15 it is the direction of the arrow F.

In the lighter, which is the object of the invention, in addition to the rotation resistance force that the contact stone (6) generates in its contact with the wheel's (8) teeth (9), when the stone (6) is pushed against the wheel (8) by an antagonistic force generated by the spring (7); it is again included in the original element (15), that functionally acting as a spring, is capable of creating an additional resistance force when the discs (10) rotate. Due to the singularity of the geometries of the contact between the wheel(s) (10) and the spring (15), and due to the structural characteristics defined in the spring's (15) design, the resistance force can adapt to the necessities of the operational force of the finger so that wheel (8) rotates when operated by an adult and the wheel (8) does not rotate when operated by a child, whose strength is limited by his physiological characteristics. Therefore, the originality of this mechanism lies in that it can be applied, if desired, regardless of the geometry of the contact surface of the wheel (10) with the finger; i.e. it is adaptable to the type of spark wheel used in the lighter.

Further, and unlike other existing safety systems on the market, the mechanism is reliable, given that it is not affected by the degradation of any element, and acts regardless of the wear due to use of the pyrophoric stone.

Figure 7:
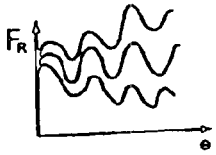
FIG. 7 graphically shows several singular characteristic curves of the rotation resistance force produced by the device of the invention.
Figure 8:
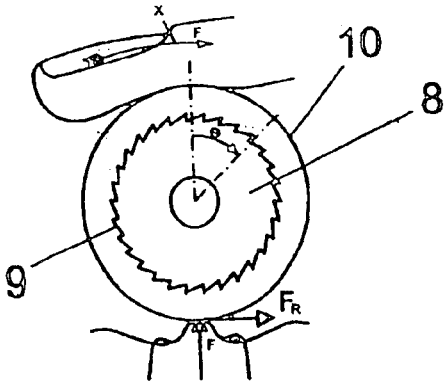
FIG. 8 shows a schematic representation of a pull train wherein the two actuators have a smooth geometry in their contact surface with the finger and spring. A spark wheel has teeth that scratch the pyrophoric stone. The actuator(s) that transmit the rotation movement to the former and the finger that operates them in the direction of operational rotation that generates pyrophoric energy are also shown. The specific geometry of the spring which produces a radial resistance force when the actuators rotate when operated by the finger, is also shown.
Figure 9:
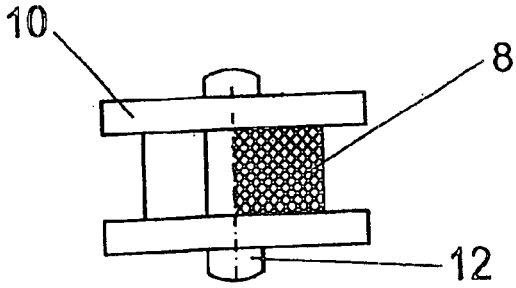
FIG. 9 shows a plan view of the pull train array wherein the two actuators show smooth surfaces with two uniform or quasi-uniform profile geometries throughout their circular expansion.
Figure 10:
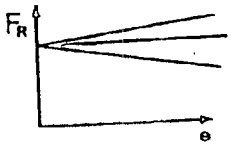
FIG. 10 graphically shows, several singular characteristic curves of the rotation resistance force produced by the device.
Figure 11:
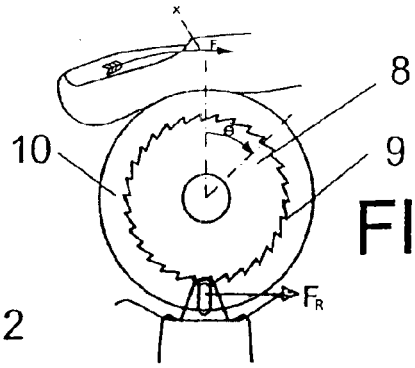
FIG. 11 shows a schematic representation of a pull train, wherein at least one of the actuators shows a rough geometry of the lateral face in its contact surface between finger and spring, a spark wheel whose teeth scratch the pyrophoric stone, the actuator(s) that transmit the rotation movement to the former and the finger that operates them in the direction of operational rotation that generates pyrophoric energy. The specific geometry of the spring which produces an axial resistance force when the actuators rotate, when operated by the finger, is also shown.
Figure 12:
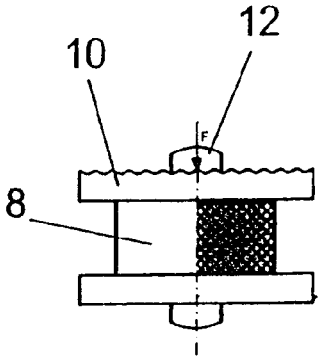
FIG. 12 shows a plan view of the pull train array wherein the actuator shows a smooth lateral contact surface with the spring, and thy other actuator shows a rough lateral contact surface with the spring, with uniform or quasi-uniform profile geometry throughout its lateral annular expansion.
Figure 13:
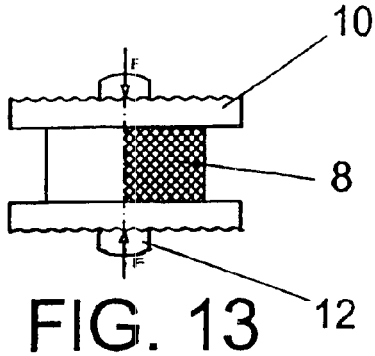
FIG. 13 also shows a plan view of a pull train array wherein the two actuators show rough contact surfaces with the spring with uniform or quasi-uniform profile geometry throughout its lateral annular expansion.
Figure 14:
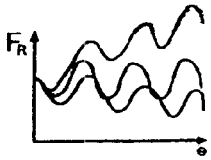
FIG. 14 graphically shows several singular characteristic curves of the rotation resistance force produced by the device.
Figure 15:
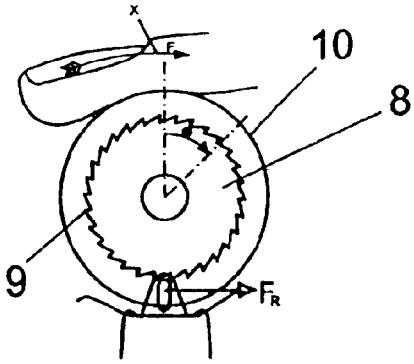
FIG. 15 shows a schematic representation of a pull train wherein the two actuators show a smooth geometry of the lateral face in its contact surface with the spring, a spark wheel whose teeth scratch the pyrophoric stone, the actuator(s) that transmit the rotation movement to the former and the finger that operates them in the direction of operational rotation that generate pyrophoric energy. The specific geometry of the spring which produces an axial resistance force when the actuators rotate when operated by the finger, is also shown.
Figure 16:
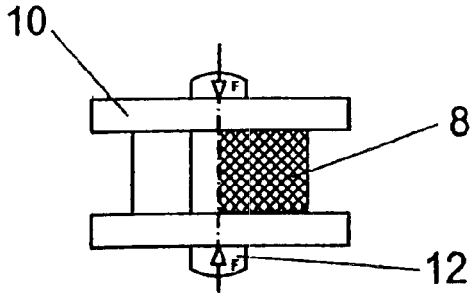
FIG. 16 shows a plan view of a pull train array wherein the two actuators show smooth lateral contact surfaces with the spring, with uniform or quasi-uniform profile geometry throughout its lateral annular expansion.
Figure 17:
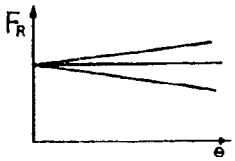
FIG. 17 graphically shows several singular characteristic curves of the rotation resistance force produced by the device.

In the embodiments presented, the different characteristics of the resistant force that this additional element (15) creates, show continuous characteristic values, FIGS. 10 and 17, obtained through smooth or quasi-smooth contact surfaces between the spring (15) and wheel(s) (10), FIGS. 8, 9, 15 and 16, and alternating or fluctuating over an average value, FIGS. 7 and 14, obtained by means of an non-smooth contact surface between spring (15) and wheel(s) 10, FIGS. 4, 5, 6, 11, 12 and 13. In both cases, and depending on the special characteristics of the spring's (15) design, the average value of the resistant force in accordance with wheel's rotation angle could be constant, progressive (increasing) or regressive (decreasing).

What is claimed is:

1. A pocket lighter, comprising:

a fuel reservoir (1); valve (2) that regulates the opening and closing of the reservoir (1) and is equipped with an outlet (3), which, when the lighter is in vertical position, determines an outlet level (4); a pyrophoric stone (6); a toothed wheel (8), rotatable and adapted to produce sparks directed towards said valve (2), on rotating in a first direction and rubbing said stone (6) against said wheel (8), said wheel being equipped with two discs (10) with end journals (12); a housing (13) for each of said end journals (12), and a braking device having a stator and a rotor, said discs (10), in addition to performing the function of force transmission between finger and wheel (8), also function as the rotor in the braking device, and the stator is formed by an element (15) which rubs against the discs so as to provide additional resistance that does not deteriorate over time.

2. The pocket lighter according to claim 1, wherein the stator element (15) is an element that forms part of support(s) where the housings are located.

3. The pocket lighter according to claim 1, wherein the stator element (15) acts on the disc (10) in a radial direction.

4. The pocket lighter according to claim 1, wherein the stator element (15) acts on the disc (10) in a tangential direction.

5. The pocket lighter according to claim 1, wherein the stator element (15) is formed by a spring of metallic material that has a braking force on the disc (10) that is generated by a pre-charge from mechanical interference due to assembly of the journals (12) in the housings (13), or by displacement of the journals (12) in the housings (13), or by a combination of pre-charge and displacement.

6. The pocket lighter according to claim 5, wherein at least one disc (10) that performs the rotor function in the braking device has a flat surface geometry in a contact region with the stator element, whereby variable braking forces are produced by deformation of the spring, or by displacement of the disc (10) on the journal (12) housings (13) or a combination of both spring deformation and disc displacement.

7. The pocket lighter according to claim 1, wherein at least one disc (10) that performs the rotor function in the barking device has a smooth surface geometry in a contact region with the stator element so that the disc has a constant rotation resistance force rate.

8. The pocket lighter according to claim 1, wherein the valve includes a button structure engageable for actuating the valve, the stator element being a part of the button structure.

9. The pocket lighter according to claim 1, wherein the stator element is an independent element.

10. The pocket lighter according to claim 9, wherein the stator element is made of metal.

11. The pocket lighter according to claim 9, wherein the stator element is made of plastic.

* * * * *